US010614969B2

(12) United States Patent
Ishikawa et al.

(10) Patent No.: US 10,614,969 B2
(45) Date of Patent: Apr. 7, 2020

(54) METHOD FOR MANUFACTURING ELECTRODE MATERIAL AND ELECTRODE MATERIAL

(71) Applicant: MEIDENSHA CORPORATION, Tokyo (JP)

(72) Inventors: Keita Ishikawa, Tokyo (JP); Shota Hayashi, Tokyo (JP); Hideaki Fukuda, Numazu (JP); Kosuke Hasegawa, Numazu (JP); Kenta Yamamura, Numazu (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 16/477,331

(22) PCT Filed: Nov. 8, 2017

(86) PCT No.: PCT/JP2017/040189
§ 371 (c)(1),
(2) Date: Jul. 11, 2019

(87) PCT Pub. No.: WO2018/142709
PCT Pub. Date: Aug. 9, 2018

(65) Prior Publication Data

US 2019/0362910 A1 Nov. 28, 2019

(30) Foreign Application Priority Data

Feb. 2, 2017 (JP) ..... 2017-017351

(51) Int. Cl.
*H01H 1/025* (2006.01)
*H01H 1/02* (2006.01)
(Continued)

(52) U.S. Cl.
CPC ..... *H01H 1/0206* (2013.01); *B22F 3/26* (2013.01); *B22F 7/06* (2013.01); *C22C 27/04* (2013.01);
(Continued)

(58) Field of Classification Search
CPC .... H01H 1/0206; H01H 1/025; H01H 11/048; B22F 7/06; B22F 3/26; C22C 27/04; C22C 27/06
See application file for complete search history.

(56) References Cited

U.S. PATENT DOCUMENTS 6,551,374 B2 4/2003 Doh et al.
8,221,517 B2 7/2012 Mirchandani et al.
(Continued)

FOREIGN PATENT DOCUMENTS

JP 63-266720 A 11/1988
JP 05-047275 A 2/1993
(Continued)

OTHER PUBLICATIONS

Japanese Office Action (Notice of Reasons for Refusal) and English translation, Application No. 2017-017351, dated Dec. 19, 2017, 4 pages.
(Continued)

*Primary Examiner* — Truc T Nguyen
(74) *Attorney, Agent, or Firm* — Foley & Lardner LLP

(57) ABSTRACT

Disclosed is a method for manufacturing an electrode material (1), wherein the electrode material includes: a center part (2) containing Cu, Cr and a heat resistant element and having superior large-current interruption and capacitor switching capabilities; and an outer circumferential part (3) disposed on an outer circumference of the center part (2). The outer circumferential part (3) contains Cu and Cr and has superior withstand voltage capability. The electrode
(Continued)

material (1) is manufactured by molding a solid solution powder of Cr and the heat resistant element, molding a Cr powder integrally around an outer circumference of the molded body of the solid solution powder and infiltrating the integrally molded body with Cu etc.

6 Claims, 7 Drawing Sheets

(51) Int. Cl.

| | |
|---|---|
| ***C22C 27/06*** | (2006.01) |
| ***B22F 3/26*** | (2006.01) |
| ***C22C 27/04*** | (2006.01) |
| ***H01H 11/04*** | (2006.01) |
| ***B22F 7/06*** | (2006.01) |

(52) U.S. Cl.
CPC ..... *C22C 27/06* (2013.01); *H01H 1/025* (2013.01); *H01H 11/048* (2013.01)

(56) References Cited

U.S. PATENT DOCUMENTS

| | | | | |
|---|---|---|---|---|
| 9,281,136 | B2 | 3/2016 | Noda et al. | |
| 9,719,155 | B2 | 8/2017 | Kitakizaki et al. | |
| 9,724,759 | B2 | 8/2017 | Kitakizaki et al. | |
| 9,959,986 | B2 | 5/2018 | Kitakizaki et al. | |
| 2006/0081560 | A1* | 4/2006 | Kikuchi | H01H 1/0203 218/123 |
| 2014/0103012 | A1* | 4/2014 | Liu | H01H 33/6644 218/132 |
| 2015/0060410 | A1* | 3/2015 | Campbell | H01H 1/0206 218/127 |
| 2015/0200059 | A1 | 7/2015 | Noda et al. | |
| 2016/0141124 | A1* | 5/2016 | Pohle | H01H 11/04 419/18 |
| 2016/0332231 | A1* | 11/2016 | Ishikawa | B22F 1/0014 |
| 2016/0369373 | A1 | 12/2016 | Kitakizaki et al. | |
| 2017/0051405 | A1* | 2/2017 | Fukazawa | C23C 16/45536 |
| 2017/0066055 | A1 | 3/2017 | Kitakizaki et al. | |
| 2017/0256373 | A1* | 9/2017 | Hermosillo | H01H 1/025 |
| 2018/0166225 | A1* | 6/2018 | Campbell | H01H 1/0206 |
| 2018/0174771 | A1* | 6/2018 | Hayashi | B22F 1/00 |
| 2019/0051475 | A1* | 2/2019 | Chibahara | B22D 19/00 |

FOREIGN PATENT DOCUMENTS

| | | | |
|---|---|---|---|
| JP | 2002-180150 | A | 6/2002 |
| JP | 2010-277962 | A | 12/2010 |
| JP | 2012-7203 | A | 1/2012 |
| JP | 2012-133988 | A | 7/2012 |
| JP | 2015-78435 | A | 4/2015 |
| JP | 2015-138682 | A | 7/2015 |
| JP | 5861807 | B1 | 2/2016 |
| JP | 5880789 | B1 | 3/2016 |
| JP | 2016-65281 | A | 4/2016 |
| JP | 5904308 | B2 | 4/2016 |
| JP | 6323578 | B1 | 5/2018 |
| WO | WO 2015/133262 | A1 | 9/2015 |
| WO | WO 2015/133264 | A1 | 9/2015 |

OTHER PUBLICATIONS

Written Amendment to Japanese Office Action and English translation, Application No. 2017-017351, dated Feb. 2, 2018, 4 pages.
Japanese Notice of Allowance (Decision to Grant a Patent) and English translation, Application No. 2017-017351, dated Mar. 13, 2018, 6 pages.
Chinese Office Action and English Translation, Application No. 201780084524.5, dated Dec. 9, 2019, 13 pages.
German Office Action and English translation, dated Jan. 30, 2020, 12 pages.

* cited by examiner

REFLECTED ELECTRON IMAGE
AT ×50 MAGNIFICATION

REFLECTED ELECTRON IMAGE
AT ×500 MAGNIFICATION

FIG. 6
(a)
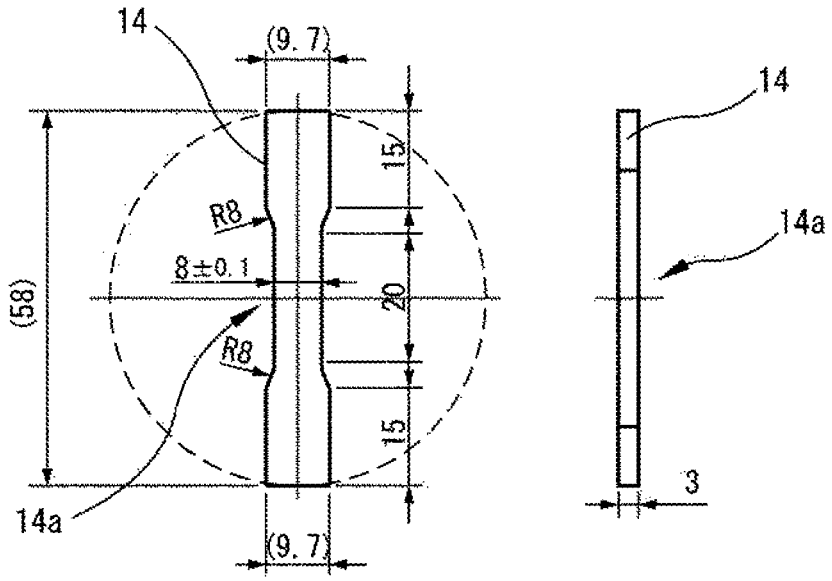
TENSILE TEST SAMPLE
(b)
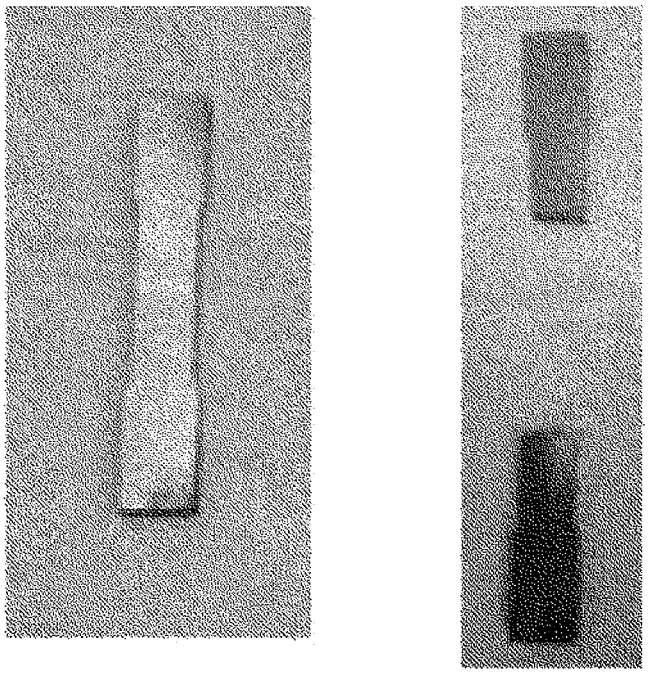
SAMPLE STATE BEFORE AND AFTER TEST
(LEFT: BEFORE TEST, RIGHT: AFTER TEST)

FIG. 7

| | Reference Ex. 1 | Reference Ex. 2 | Ex. 1 | Ex. 2 | Ex. 3 |
|---|---|---|---|---|---|
| Electrode material (center part-outer circumferential part) | Cu25Cr7.5Mo67.5 | conventional Cu50Cr12.5Mo37.5 | composite alloy | composite alloy | composite alloy |
| Raw material of center molded body | ---- | ---- | MoCr 5.7 μm | MoCr 5.7 μm | MoCr 5.7 μm |
| Mixing ratio (Mo:Cr weight ratio) of Raw material of center molded body | 9:1 | 3:1 | 9:1 | 9:1 | 9:1 |
| Raw filling material of outer circumferential part | ---- | ---- | Cr 64 μm | Cr 64 μm | Cr 39 μm |
| Press pressure for center molded body | ---- | ---- | 3 | 3 | 3 |
| Sintering of center molded body | ---- | ---- | ---- | ---- | ---- |
| Press pressure for integrally molded body | ---- | ---- | 3 | 3 | 3 |
| Sintering of integrally molded body | ---- | ---- | ○ | ---- | ○ |
| Maximum tensile stress (relative value) | 4.1 | 1.1 | 1.4 | ---- | ---- |
| Area ratio center part:outer circumferential part | 1:0 | 1:0 | 1:2 | 1:2 | 1:2 |
| Number of forming treatments (relative value) | 1.25 or more | 1.0 contact resistance decrease rate 0% | 1.0 contact resistance decrease rate 10% | ---- | ---- |
| Capacitor switching test result | not tested | reignition probability 12.5% (6 times out of 48) | reignition probability 0% (0 time out of 84) | ---- | ---- |
| Interruption test result | ---- | ○ | ---- | ---- | ---- |
| Judgment | × | × | ○ | ○ | ○ |

FIG. 7 (continued)

| | Ex. 4 | Ex. 5 | Ex. 6 | Ex. 7 | Ex. 8 | Ex. 9 |
|---|---|---|---|---|---|---|
| Electrode material (center part-outer circumferential part) | composite alloy | composite alloy | composite alloy | composite alloy | composite alloy | composite alloy |
| Raw material of center molded body | MoCr 5.7 μm | MoCr 5.7 μm | MoCr 5.7 μm | MoCr 5.7 μm | MoCr 7.1 μm | MoCr 23.7 μm |
| Mixing ratio (Mo:Cr weight ratio) of Raw material of center molded body | 9:1 | 9:1 | 9:1 | 9:1 | 3:1 | 1:1 |
| Raw filling material of outer circumferential part | Cr 39 μm | Cr 64 μm | Cr 64 μm | Cr 64 μm | Cr 64 μm | Cr 64 μm |
| Press pressure for center molded body | 2 | 3 | 3 | 3 | 3 | 3 |
| Sintering of center molded body | ---- | ○ | ○ | ---- | ---- | ---- |
| Press pressure for integrally molded body | 2 | 3 | 3 | 3 | 3 | 3 |
| Sintering of integrally molded body | ○ | ---- | ○ | ○ | ○ | ○ |
| Maximum tensile stress (relative value) | ---- | 1.3 | 1.0 | ---- | ---- | ---- |
| Area ratio center part:outer circumferential part | 1:2 | 1:2 | 1:2 | 3:2 | 1:2 | 1:2 |
| Number of forming treatments (relative value) | ---- | ---- | ---- | ---- | ---- | ---- |
| Capacitor switching test result | ---- | ---- | ---- | ---- | ---- | ---- |
| Interruption test result | ---- | ---- | ---- | ---- | ---- | ---- |
| Judgment | ○ | ○ | ○ | ○ | ○ | ○ |

METHOD FOR MANUFACTURING ELECTRODE MATERIAL AND ELECTRODE MATERIAL

FIELD OF THE INVENTION

The present invention relates to an electrode material for use in a vacuum interrupter etc. More particularly, the present invention relates to a method for manufacturing an electrode material where a large-current interruption capability and a capacitor switching capability are required and to the electrode material.

BACKGROUND ART

An electrode material used for an electrode of a vacuum interrupter (VI) etc. is required to satisfy the following characteristics: (1) high interrupting capacity; (2) high withstand voltage; (3) low contact resistance; (4) high welding resistance; (5) low contact consumption; (6) low interrupting current; (7) good workability; and (8) high mechanical strength.

Since some of the above characteristics are in a trade-off relationship, there is no electrode material satisfying all of the above characteristics. Electrode materials are thus used properly depending on the applications of interrupters, such as those for large-current interruption and for high withstand voltage. How to develop an electrode material with different characteristics has been an important issue.

In recent years, the conditions of use of vacuum interrupters have become severe, and at the same time, the range of applications of vacuum interrupters to capacitor circuits has been widening. In a capacitor circuit, a voltage twice or three times as high as the usual is applied between electrodes. On this account, it is assumed that contact surfaces of the electrodes sustain significant damage by arc generated at the time of current interruption or current switching operation, thereby easily causing the reignition of arc. There has accordingly been an increasing demand for a contact material with superior withstand voltage and current interruption capabilities to those of conventional Cu—Cr electrode materials.

As a method for production of Cu—Cr electrodes with superior electrical characteristics such as current interruption capability and withstand voltage capability, an electrode production method is known in which a Cu powder as a base material is mixed with a Cr powder for improvement of electrical characteristics and a powder of an heat resistant element (such as molybdenum (Mo), tungsten (W), niobium (Nb), tantalum (Ta), vanadium (V), zirconium (Zr) or the like) for micronization of Cr particles, followed by press-molding the mixed powder in a mold and sintering the molded body (see, for example, Patent Documents 1 and 2).

More specifically, a Cu—Cr electrode material is prepared using a Cr powder of 200 to 300 μm particle size as a raw material; and a heat resistant element is added to the Cu—Cr electrode material so as to allow micronization of the Cr powder through a microstructure technique, that is, promote alloying of Cr and the heat resistant element and enhance deposition of fine Cr—X particles (where X is the heat resistant element) in the Cu base material phase. As a consequence, the electrode has a composition in which Cr particles of 20 to 60 μM diameter are uniformly dispersed in the Cu base material phase in the form of incorporating therein the heat resistant element.

In order to improve the electrical characteristics such as current interruption capability and withstand voltage capability of the above electrode material, it is required to increase the contents of Cr and the heat resistant element in the Cu base material phase and to finely and uniformly disperse the particles of Cr and of the solid solution of Cr and the heat resistant element in the Cu base material phase.

As a result of extensive researches, the present inventors have invented an electrode material of Cu—Cr-heat resistant element (e.g. Mo) system (see, for example, Patent Documents 3 to 5). This electrode material combines uniform dispersion of fine Cr-containing particles with uniform dispersion of fine Cu structures as a highly conductive component and shows superior large-current interruption and withstand voltage capabilities.

In general, contact materials for use in interrupters etc. need to be stabilized in withstand voltage capability by a voltage-forming treatment in which fine projections or adhered foreign substances on contact surfaces are flashed over between contacts or by a current-forming treatment in which contact surfaces are melted by arc.

However, the electrode material of Cu—Cr-heat resistant element (e.g. Mo) system is higher in surface hardness and melting point than the conventional Cu—Cr electrode materials. There is thus a possibility that the energy required for stabilization of withstand voltage capability may become high. There is also a possibility that fouling caused inside the vacuum interrupter by the stabilization treatment becomes a factor of unstabilization of withstand voltage capability. Furthermore, the electrode material of Cu—Cr-heat resistant element (e.g. Mo) system is equal in energization capability to the conventional CuCr electrode materials whereby a smaller electrode diameter cannot be achieved and whereby a shortening of the time required for the forming treatment by decrease of contact area cannot be expected.

PRIOR ART DOCUMENTS

Patent Documents

Patent Document 1: Japanese Laid-Open Patent Publication No. 2012-7203

Patent Document 2: Japanese Laid-Open Patent Publication No. 2002-180150

Patent Document 3: Japanese Patent No. 5861807

Patent Document 4: Japanese Patent No. 5880789

Patent Document 5: Japanese Patent No. 5904308

Patent Document 6: Japanese Laid-Open Patent Publication No. 2016-065281

Patent Document 7: Japanese Laid-Open Patent Publication No. 2012-133988

Patent Document 8: Japanese Laid-Open Patent Publication No. H05-047275

Patent Document 9: Japanese Laid-Open Patent Publication No. S63-266720

Patent Document 10: Japanese Laid-Open Patent Publication No. 2015-078435

Patent Document 11: Japanese Laid-Open Patent Publication No. 2010-277962

SUMMARY OF THE INVENTION

It is an object of the present invention to provide a method for manufacturing an electrode material with superior current interruption and withstand voltage capabilities.

In accordance with one aspect of the present invention to achieve the above object, there is provided a manufacturing method of an electrode material, comprising: forming a molded body by molding a powder of a solid solution of Cr and at least one kind of heat resistant element selected from Mo, W, Ta, Nb, V and Zr; filling and molding a powder of Cr around an outer circumference of the molded body, thereby forming an integrally molded body; and infiltrating the integrally molded body with a conductive element selected from Cu, Ag and an alloy of Cu and Ag.

In accordance with another aspect of the present invention to achieve the above object, there is provided a manufacturing method of an electrode material as described above, wherein the manufacturing method further comprises sintering the integrally molded body, and wherein, in the infiltrating, the sintered integrally molded body is infiltrated with the conductive element.

In accordance with still another aspect of the present invention to achieve the above object, there is provided a manufacturing method of an electrode material as described above, wherein the manufacturing method further comprises sintering the molded body, and wherein, in the filling and molding, the integrally molded body is obtained by filling and molding the powder of Cr around the sintered molded body.

In accordance with yet another aspect of the present invention to achieve the above object, there is provided a manufacturing method of an electrode material as described above, wherein, in X-ray diffraction measurement of the powder of the solid solution, either a peak corresponding to Cr or a peak corresponding to the heat resistant element has disappeared.

In accordance with one aspect of the present invention to achieve the above object, there is provided an electrode material comprising: a center part having a good current interruption capability; and an outer circumferential part disposed on an outer circumference of the center part, wherein the center part has a composite metal composition in which solid solution particles are uniformly dispersed in a Cu phase, the solid solution particles being formed of a solid solution of Cr and at least one kind of heat resistant element selected from Mo, W, Ta, Nb, V and Zr, wherein the composite metal composition comprises, in terms of a weight ratio with respect to the composite metal composition, 20 to 70% of Cu, 1.5 to 64% of Cr and 6 to 76% of the heat resistant element, with the balance being unavoidable impurities, wherein the solid solution particles in the composite metal composition have an average particle diameter of 20 μm or smaller and are uniformly dispersed in the Cu phase with a dispersion state index of 1.0 or lower, and wherein the outer circumferential part comprises 60 wt % or more of Cr based on a weight of the outer circumferential part, with the balance being Cu.

In accordance with another aspect of the present invention to achieve the above object, there is provided an electrode material as described above, wherein the outer circumferential part comprises 75 wt % to 90 wt % of Cr based on the weight of the outer circumferential part.

It is possible according to the present invention to obtain the electrode material with superior interruption and withstand voltage capabilities.

BRIEF DESCRIPTION OF DRAWINGS

FIG. 6(*a*) is a schematic view of a test sample; and FIG. 6(*b*) is pictorial views of the test sample before and after a tensile test.

FIG. 7 is a diagram showing details of electrode materials according to Examples 1 to 9 and Reference Examples 1 and 2.

DESCRIPTION OF EMBODIMENTS

An electrode material manufacturing method and an electrode material according to embodiments of the present invention will be described in detail below with reference to the drawings. In the following description of the embodiments, an average particle diameter, a median diameter d50, a volume-based relative particle amount and the like mean values measured by a laser diffraction particle size analyzer (available from CILAS Inc. under the trade name of CILAS 1090L), unless otherwise specified.

Figure 1:
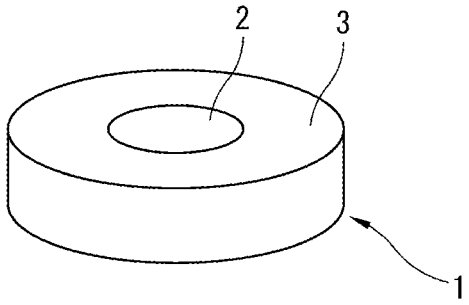
FIG. 1 is a schematic view of an electrode material according to an embodiment of the present invention.

Referring to FIG. 1, an electrode material 1 manufactured by an electrode material manufacturing method according to one embodiment of the present invention includes a cylindrical column-shaped center part 2 and an outer circumferential part 3 disposed on an outer circumference of the center part 2. For example, the center part 2 is a region of Cu—Cr-heat resistant element system having superior large-current interruption and capacitor switching capabilities; and the outer circumferential part 3 is a region of Cu—Cr system having superior withstand voltage capability.

The center part 2 is formed by e.g. making a skeleton of a solid solution of chromium (Cr) and a heat resistant element and infiltrating the skeleton with a conductive element such as copper (Cu), silver (Ag) or Cu—Ag alloy. Preferably, the center part 2 is formed using an electrode material disclosed in Patent Documents 3 to 5 etc. Hereinafter, the constituent elements of the center part 2 will be specifically explained below.

The heat resistant element can be a single element, or a combination of elements, selected from molybdenum (Mo), tungsten (W), tantalum (Ta), niobium (Nb), vanadium (V), zirconium (Zr), beryllium (Be), hafnium (Hf), iridium (Ir), platinum (Pt), titanium (Ti), silicon (Si), rhodium (Rh), ruthenium (Ru) and the like. Particularly preferred are Mo, W, Ta, Nb, V and Zr, each of which has a prominent effect of micronizing Cr particles. In case of using the heat resistant element in the form of a powder, the powder of the heat resistant element has an average particle diameter of e.g. 2 to 20 μM, preferably 2 to 10 μm, such that Cr-containing particles (e.g. solid solution particles of the heat resistant element and Cr) are made fine and uniformly dispersed in the electrode material. The content of the heat resistant element in the center part 2 is generally 6 to 76 wt %, preferably 32 to 68 wt %, based on the weight of the center part 2. In this content range, the center part 2 archives improved withstand voltage and current interruption capabilities without impairment of mechanical strength and workability.

The content of Cr in the center part 2 is generally 1.5 to 64 wt %, preferably 4 to 15 wt %, based on the weight of the center part 2. In this content range, the center part 2 achieves improved withstand voltage and current interruption capabilities without impairment of mechanical strength and workability. In the case of using Cr in the form of a powder, the Cr powder has a particle size of e.g. −48 mesh (i.e. a particle diameter of smaller than 300 μm), −100 mesh (i.e. a particle diameter of smaller than 150 μm), more preferably −325 mesh (i.e. a particle diameter of smaller than 45 μm), so that the center part 2 can be formed with superior withstand voltage and current interruption capabilities. In particular, the use of the Cr powder with a particle size of −100 mesh leads to a reduction in the amount of residual Cr which can be a factor of increasing the particle diameter of Cu infiltrated in the electrode material.

The content of the conductive element (such as Cu, Ag or Cu—Ag alloy) in the center part 2 is generally 20 to 70 wt %, preferably 25 to 60 wt %, based on the weight of the center part 2. In this content range, the center part 2 achieves lowered contact resistance without impairment of withstand voltage and current interruption capabilities. Since the content of the conductive element in the center part 2 is determined according to the process of infiltration of the conductive element, the sum of the contents of the heat resistant element, Cr and the conductive element does not exceed 100 wt % based on the weight of the center part 2.

The outer circumferential part 3 is formed by e.g. molding a powder of Cr and infiltrating the resulting molded body with a conductive element such as Cu. There is no particular limitation on the particle diameter of Cr as the constituent of the outer circumferential part 3. The content of Cr in the outer circumferential part 3 is generally 60 wt % or more, preferably 75 wt % to 90 wt %, based on the weight of the outer circumferential part 3. In this content range, the outer circumferential part 3 achieves superior withstand voltage capability.

Referring to the flowchart of FIG. 2, the electrode material manufacturing method according to one embodiment of the present invention will be explained in detail below. Although the following explanation is given by using Mo as an example of the heat resistant element and Cu as the conductive element, the same applies to the case of using the other heat resistant element and the other conductive element.

In the mixing step S1, a heat resistant element powder (e.g. Mo powder) and a Cr powder are mixed. It is preferable to mix the Mo powder and the Cr powder such that the weight ratio of Mo to Cr is 1 or more to 1, more preferably 3 or more to 1, still more preferably 9 or more to 1. In this weight ratio range, the center part 2 can be formed with superior withstand voltage and current interruption capabilities.

In the provisional sintering step S2, the mixed powder obtained by mixing the Mo powder and the Cr powder in the mixing step S1 (hereinafter simply referred to as the "mixed powder") is put into a container reactive with neither Mo nor Cr (such as, for example, an alumina container), and then, subjected to provisional sintering at a predetermined temperature (e.g. 1250° C. to 1500° C.) under a non-oxidizing atmosphere (e.g. hydrogen atmosphere or vacuum atmosphere). By the provisional sintering, there is obtained a MoCr solid solution where Mo and Cr are mutually dissolved and diffused into each other. In the provisional sintering step S2, the provisional sintering is not necessarily performed until all of Mo and Cr are formed into the solid solution. However, the use of the provisional sintered body in which either one or both of X-ray diffraction (XRD) peaks corresponding to Mo and Cr elements have completely disappeared (that is, either one of Mo and Cr has been completely dissolved in the other element) contributes to a higher withstand voltage capability of the center part 2. For this reason, it is preferable that: in the case of the Mo powder being mixed in a large amount, the sintering temperature and time of the provisional sintering step S2 are set such that at least the peak corresponding to Cr has disappeared in the spectrum of the MoCr solid solution measured by X-ray diffraction; and, in the case of the Cr powder being mixed in a large amount, the sintering temperature and time of the provisional sintering step S2 are set such that at least the peak corresponding to Mo has disappeared in the spectrum of the MoCr solid solution measured by X-ray diffraction.

In the provisional sintering step S2, the mixed powder may be subjected to press forming (press treatment) before the provisional sintering. By the press forming, the mutual diffusion of Mo and Cr can be promoted so as to shorten the provisional sintering time and to decrease the provisional sintering temperature. There is no particular limitation on the pressure applied for the press forming. The press forming pressure is preferably 0.1 t/cm$^2$ or lower. If the press forming pressure of the mixed powder is very high, the provisional sintered body may become hard and thereby difficult to pulverize in the subsequent pulverization step S3.

In the pulverization step S3, a powder of the MoCr solid solution (hereinafter also referred to as "MoCr powder") is obtained by pulverizing the MoCr solid solution with a pulverizer (such as planetary ball mill). Although it is preferable to perform the pulverization under a non-oxidizing atmosphere in the pulverization step S3, the pulverization may be performed in the air. The pulverization conditions are set so as to allow pulverization of the particles (secondary particles) where the MoCr solid solution particles are bonded to each other. The longer the pulverization time, the smaller the average particle diameter of the particles of the MoCr solid solution. By setting the pulverization conditions such that the volume-based relative particle amount of particles of 30 μM or smaller diameter (preferably, particles of 20 μm or smaller diameter) in the MoCr powder becomes 50% or more, there can be obtained the center part 2 in which MoCr particles (i.e. particles formed by mutual dissolution and diffusion of Mo and Cr) and Cu structures are uniformly dispersed.

In the molding step S4, the MoCr powder is subjected to molding. For example, the molding is performed by press-molding the MoCr powder with a pressure of 2 t/cm$^2$.

In the main sintering step S5, the simple molded body of the MoCr powder is subjected to main sintering, thereby forming a MoCr sintered body (MoCr skeleton). For example, the main sintering is performed by sintering the molded body of the MoCr powder at 1150° C. for 2 hours under a vacuum atmosphere. The main sintering step S5 is a step of forming the denser MoCr sintered body by deformation and bonding of the MoCr particles. It is preferable to perform the sintering of the MoCr powder at a temperature higher than or equal to the temperature condition of the later Cu infiltration step S7. For example, the sintering temperature is preferably set to 1150° C. or higher. This is because, when the main sintering is performed at a temperature lower than the infiltration temperature, a gas contained in the MoCr sintered body newly develops during the Cu infiltration and remains in the resulting Cu-infiltrated body. The presence of such a gas becomes a factor of impairment of withstand voltage and current interruption capabilities. In the main sintering step S5, the sintering temperature is hence set higher than or equal to the Cu infiltration temperature and lower than or equal to the melting point of Cr. The sintering temperature is preferably in the range of 1150 to 1500° C. In this temperature range, the MoCr particles can be closely packed and sufficiently degassed. The main sintering step S5 is not necessarily performed. The outer circumferential part forming step S6 and the Cu infiltration step S7 may be performed on the molded body obtained in the molding step S4 or the sintered body (MoCr solid solution) obtained in the provisional sintering step S2.

In the outer circumferential part forming step S6, a Cr powder is filled and press-molded (e.g. with a pressure of 3 $t/cm_2$) on an outer circumference of the MoCr sintered body obtained in the main sintering step S5, thereby forming an integrally molded body. Then, the integrally molded body is sintered e.g. at 1150° C. for 2 hours under a vacuum atmosphere and thereby processed into a base material body of MoCr phase and Cr phase (porous composite sintered body). In the outer circumferential part forming step S6, the sintering is not necessarily performed. The subsequent Cu infiltration step S7 may be performed on the integrally molded body without sintering.

In the Cu infiltration step S7, the base material body (porous composite sintered body) is infiltrated with Cu. For example, the MoCr sintered body is infiltrated with Cu by placing a Cu plate material on the MoCr sintered body and holding them under a non-oxidizing atmosphere at a temperature of higher than or equal to the melting point of Cu for a predetermined time (for example, at 1150° C. for 2 hours).

Figure 3:
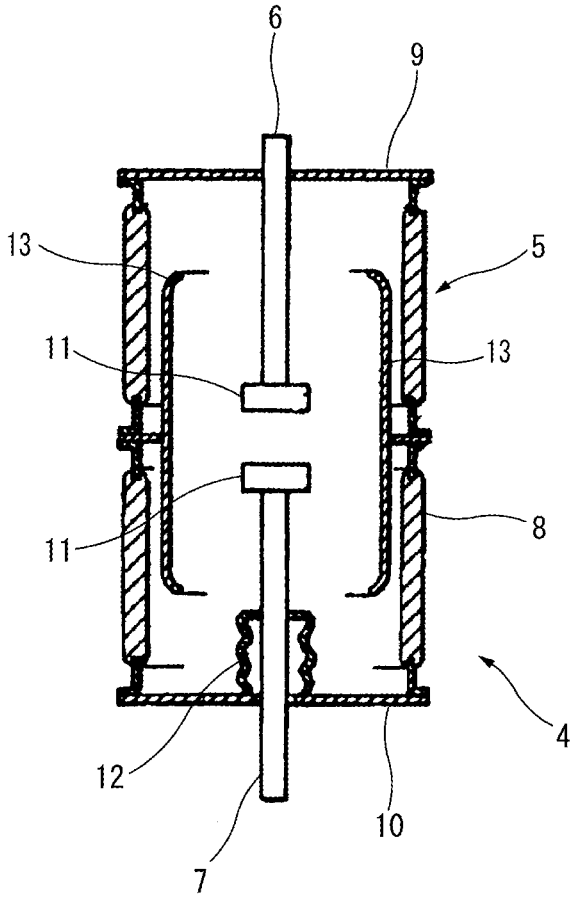
FIG. 3 is a schematic cross-sectional view of a vacuum interrupter having an electrode contact formed of the electrode material according to the embodiment of the present invention.

A vacuum interrupter can be constructed by using the electrode material manufactured by the electrode material manufacturing method according to the embodiment of the present invention (hereinafter also simply referred to as the "electrode material according to the embodiment of the present invention"). Referring to FIG. 3, the vacuum interrupter 4 using the electrode material according to the embodiment of the present invention includes a vacuum container 5, a fixed electrode 6, a movable electrode 7 and a main shield 13.

The vacuum container 5 has an insulating tube 8 sealed at both open ends thereof by a fixed-side end plate 9 and a movable-side end plate 10, respectively.

The fixed electrode 6 is fixed in a state of passing through the fixed-side end plate 9. One end of the fixed electrode 6 is fixed at a position facing and opposed to one end of the movable electrode 7 within the vacuum container 5. An electrode contact 11, which is formed of the electrode material according to the embodiment of the present invention, is disposed on an end portion of the fixed electrode 6 facing and opposed to the movable electrode 7.

The movable electrode 7 is provided through the movable-side end plate 10 so as to be coaxial with the fixed electrode 6. The movable electrode 7 is axially movable by a non-illustrated switching means for opening/closing of the fixed electrode 6 and the movable electrode 7. An electrode contact 11 is also disposed on an end portion of the movable electrode 7 facing and opposed to the fixed electrode 6. Further, a bellows 12 is disposed between the movable electrode 7 and the movable-side end plate 10 so as to allow opening/closing of the fixed electrode 6 and the movable electrode 7 by vertical movement of the movable electrode 7 while keeping the inside of the vacuum container 5 vacuum.

The main shield 13 is arranged to cover a contact part of the electrode contact of the fixed electrode 6 and the electrode contact of the movable electrode 7 and to protect the insulating tube 8 from arc generated between the fixed electrode 6 and the movable electrode 7.

Example 1

Figure 2:
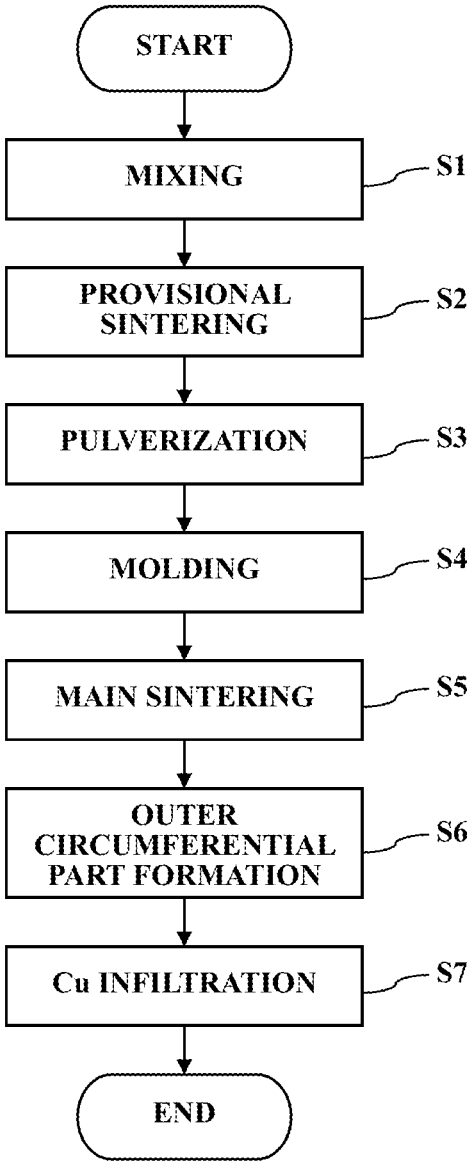
FIG. 2 is a flowchart for an electrode material manufacturing method according to an embodiment of the present invention.

An electrode material according to Example 1 was produced in accordance with the flowchart of FIG. 2. In the following explanation, the molding step S4 to the Cu infiltration step S7 will be explained in detail. (The same applies to the other Examples.) As a method for preparation of a MoCr fine powder, there are known those described in the after-mentioned Reference Examples 1 and 2. The preparation method of the MoCr fine powder is however not limited to those described in the after-mentioned Reference Examples 1 and 2.

The electrode material according to Example 1 was an electrode material produced by sintering the integrally molded body in the outer circumferential part forming step S6, without sintering the molded body (i.e. without performing the main sintering step S5), and infiltrating the resulting base material body with Cu.

A MoCr fine powder of 5.7 μm median diameter (MoCr weight ratio: Mo:Cr=9:1) was molded with a press pressure of 3 $t/cm^2$, thereby forming a molded body with a diameter ϕ of 40 mm and a length L of 24 mm. A Cr powder (median diameter: 64 μm) was filled on an outer circumference of the molded body and molded with a press pressure of 3 $t/cm^2$, thereby forming an integrally molded body with a diameter ϕ of 80 mm and a length L of 24 mm. The integrally molded body was sintered at 1150° C. for 1.5 hours under a vacuum atmosphere and thereby processed into a base material body (porous composite sintered body). The thus-formed base material body was infiltrated with Cu by placing a Cu plate material on the base material body and holding the base material body and the Cu plate material together in a vacuum furnace at 1150° C. for 2 hours. In this way, there was obtained the electrode material according to Example 1. Subsequently, the electrode material was subjected to machining so as to remove excessive Cu remaining after the Cu infiltration and allow the center part (CuCrMo region) and the outer circumferential part (CuCr region) to be exposed at a surface of the electrode material. The electrical conductivity of the electrode material according to Example 1 was measured at both sides. It was confirmed that: the electrical conductivity of the center part of the electrode material was 36% IACS; and the electrical conductivity of the outer circumferential part of the electrode material was 21% IACS.

Figure 4:
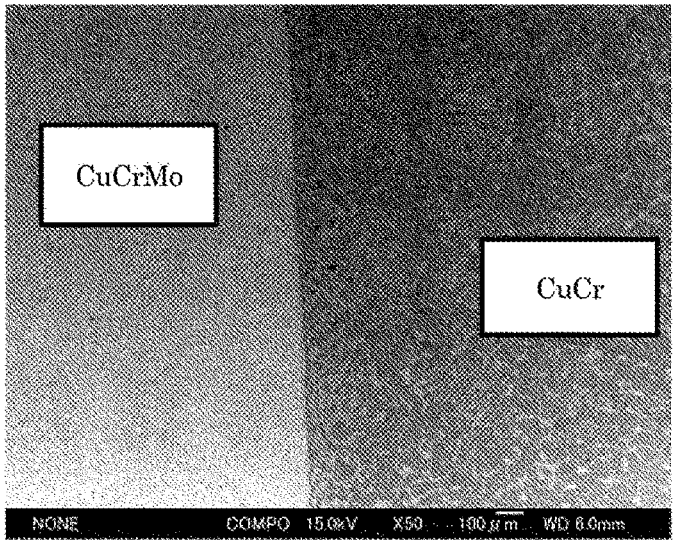
FIG. 4 is a reflected electron image of a boundary portion between two regions of the electrode material (at a magnification of 50 times).
Figure 5:
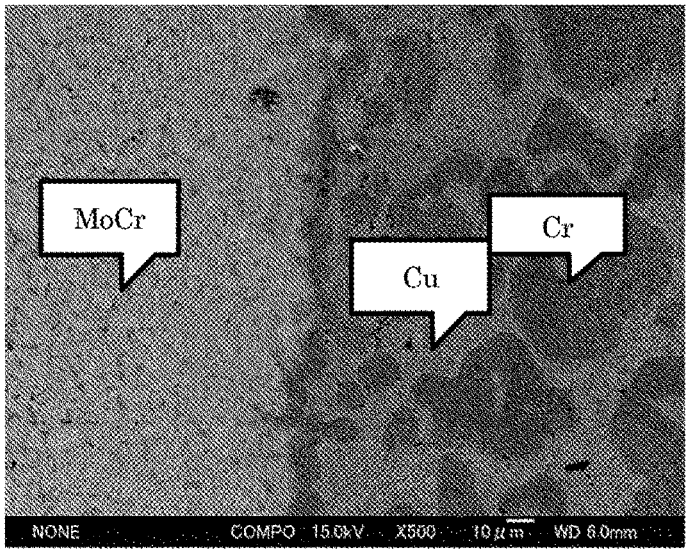
FIG. 5 is a reflected electron image of the boundary portion between two regions of the electrode material (at a magnification of 500 times).

Reflected electron images of a boundary portion between the center and outer circumferential parts of the electrode material according to Example 1 are shown in FIGS. 4 and 5. It is apparent from FIG. 4 that the center part and the outer circumferential part were bonded together with no large voids present in the joint site of the center part and the outer circumferential part. It is apparent from FIG. 5 that, in the boundary portion, the Cr particles were bonded more closely to the MoCr particles. The weight ratio of Mo and Cr in the MoCr region of the boundary portion was assumed to be about 1:1 (the weight ratio of Mo and Cr in a portion of the electrode material apart from the boundary portion was 9:1). Further, Cr particles continuing to the boundary portion was assumed to be those of Cr dissolved in Cu and diffused toward the MoCr region, but not dissolved in the MoCr particles, during the Cu infiltration. Although it is assumed that Mo was diffused into the Cr phase simultaneously with the diffusion of Cr into the MoCr region, such diffused Mo was very small and thus was unrecognizable. In this way, the boundary portion was formed with a boundary layer in which MoCr and Cr were mutually dissolved and diffused into each other so that the joint of the center part and the outer circumferential part was strong.

Herein, a tensile test was carried out using a test sample 14 as shown in FIG. 6(*a*) in order to compare the joining strength of the electrode material according to Example 1 with that of a CuCr material (as the after-mentioned electrode material according to Comparative Example 1) currently used as contact material of a vacuum interrupter in terms of tensile strength. The tensile strength can be regarded as an index of electrode cracking or deformation at each switching operation of the vacuum interrupter. It is accordingly judged that the electrode material, when having a maximum tensile stress higher than or equal to that of the currently-used CuCr material, is usable as a contact material of a vacuum interrupter.

The test sample was prepared by machining the electrode material according to Example 1 such that the joint site of the electrode material was present at a center portion 14*a* of the test sample 14. The maximum tensile stress of the test sample was measured by a precision universal test machine at a speed of 1 mm/min. The appearances of the test sample of the electrode material according to Example 1 before and after the tensile test are shown in FIG. 6(*b*). The maximum tensile stress of the test sample of the electrode material according to Comparative Example 1 was also measured in the same manner as Example 1. As a result of comparison of the test results, it was confirmed that the maximum tensile stress of the electrode material according to Example 1 (i.e. the strength of the joint of the center part and the outer circumferential part) was 1.4 times that of the electrode material according to Comparative Example 1. The maximum tensile stress of electrode materials, according to the after-mentioned Reference Example 1 and Examples 5 and 6 was also measured in the same manner as above. These measurement results are each shown in FIG. 7 as a relative value to the maximum tensile strength of the electrode material according to Comparative Example 1.

Example 2

An electrode material according to Example 2 was an electrode material produced by infiltrating the base material body with Cu without sintering the molded body and without sintering the integrally molded body.

A MoCr fine powder of 5.7 μm median diameter (MoCr weight ratio: Mo:Cr=9:1) was molded with a press pressure of 3 t/cm$^2$, thereby forming a molded body with a diameter ϕ of 40 mm and a length L of 24 mm. A Cr powder (median diameter: 64 μm) was filled on an outer circumference of the molded body and molded with a press pressure of 3 t/cm$^2$, thereby forming an integrally molded body with a diameter ϕ of 80 mm and a length L of 24 mm. The thus-formed integrally molded body was infiltrated with Cu by placing a Cu plate material on the integrally molded body and holding the integrally molded body and the Cu plate material together in a vacuum furnace at 1150° C. for 2 hours. In this way, there was obtained the electrode material according to Example 2. The tensile strength and electrical conductivity of the electrode material according to Example 2 were measured and confirmed to be equivalent in value to those of the electrode material according to Example 1. In other words, the electrode material according to Example 2 was confirmed as having sufficient strength to withstand mechanical impacts repeated by vacuum interrupter switching operations for a long period of time.

Example 3

An electrode material according to Example 3 was an electrode material produced by sintering the integrally molded body, without sintering the molded body, and infiltrating the resulting base material body with Cu. In this Example, the particle diameter of the Cr powder used as the raw material of the outer circumferential part was different from different from that of the electrode material according to Example 1.

A MoCr fine powder of 5.7 μm median diameter (MoCr weight ratio: Mo:Cr=9:1) was molded with a press pressure of 3 t/cm$^2$, thereby forming a molded body with a diameter ϕ of 40 mm and a length L of 24 mm. A Cr powder (median diameter: 39 μm) was filled on an outer circumference of the molded body and molded with a press pressure of 3 t/cm$^2$, thereby forming an integrally molded body with a diameter ϕ of 80 mm and a length L of 24 mm. The integrally molded body was sintered at 1150° C. for 1.5 hours under a vacuum atmosphere and thereby processed into a base material body (porous composite sintered body). The thus-formed base material body was infiltrated with Cu by placing a Cu plate material on the base material body and holding the base material body and the Cu plate material together in a vacuum furnace at 1150° C. for 2 hours. In this way, there was obtained the electrode material according to Example 3. The tensile strength and electrical conductivity of the electrode material according to Example 3 were measured and confirmed to be equivalent in value to those of the electrode material according to Example 1.

Example 4

An electrode material according to Example 4 was an electrode material produced in the same manner as the electrode material according to Example 3, except for changing the molding pressures for the molded body and the integrally molded body.

A MoCr powder of 5.7 μm median diameter (MoCr weight ratio: Mo:Cr=9:1) was molded with a press pressure of 2 t/cm$^2$, thereby forming a molded body with a diameter ϕ of 40 mm and a length L of 24 mm. A Cr powder (median diameter: 39 μm) was filled on an outer circumference of the molded body and molded with a press pressure of 2 t/cm$^2$, thereby forming an integrally molded body with a diameter ϕ of 80 mm and a length L of 24 mm. The integrally molded body was sintered at 1150° C. for 1.5 hours under a vacuum atmosphere and thereby processed into a base material body (porous composite sintered body) by sintering. The thus-formed base material body was infiltrated with Cu by placing a Cu plate material on the base material body and holding the base material body and the Cu plate material together in a vacuum furnace at 1150° C. for 2 hours. In this way, there was obtained the electrode material according to Example 4. The tensile strength and electrical conductivity of the electrode material according to Example 4 were measured and confirmed to be equivalent in value to those of the electrode material according to Example 1.

As mentioned above, the electrode material with superior interruption and withstand voltage capabilities was obtained by forming the integrally molded body even when the press pressures for the molded body and the integrally molded body were changed.

Example 5

An electrode material according to Example 5 was an electrode material produced by sintering the molded body, but not sintering the integrally molded body, and infiltrating the resulting base material body with Cu.

A MoCr fine powder of 5.7 μm median diameter (MoCr weight ratio: Mo:Cr=9:1) was molded with a press pressure of 3 t/cm$^2$, thereby forming a molded body with a diameter ϕ of 40 mm and a length L of 24 mm. The molded body was sintered by being held at 1150° C. for 1.5 hours under a vacuum atmosphere. A Cr powder (median diameter: 64 μm) was filled on an outer circumference of the sintered body and molded with a press pressure of 3 t/cm$^2$, thereby forming an integrally molded body with a diameter ϕ of 80 mm and a length L of 24 mm. The thus-formed integrally molded body was infiltrated with Cu by placing a Cu plate material on the integrally molded body and holding the integrally molded body and the Cu plate material together in a vacuum furnace at 1150° C. for 2 hours. In this way, there was obtained the electrode material according to Example 5. The tensile strength and electrical conductivity of the electrode material according to Example 5 were measured and confirmed to be equivalent in value to those of the electrode material according to Example 1.

As mentioned above, the electrode material with superior interruption and withstand voltage capabilities was obtained by forming the integrally molded body even when the molded body (center part) was subjected to sintering.

Example 6

An electrode material according to Example 6 was an electrode material produced by sintering the molded body, sintering the integrally molded body and then infiltrating the resulting base material body with Cu.

A MoCr fine powder of 5.7 μm median diameter (MoCr weight ratio: Mo:Cr=9:1) was molded with a press pressure of 3 t/cm$^2$, thereby forming a molded body with a diameter ϕ of 40 mm and a length L of 24 mm. The molded body was sintered by being held at 1150° C. for 1.5 hours under a vacuum atmosphere. A Cr powder (median diameter: 64 μm) was filled on an outer circumference of the sintered body and molded with a press pressure of 3 t/cm$^2$, thereby forming an integrally molded body with a diameter ϕ of 80 mm and a length L of 24 mm. The integrally molded body was sintered at 1150° C. for 1.5 hours under a vacuum atmosphere and thereby processed into a base material body (porous composite sintered body). The thus-formed base material body was infiltrated with Cu by placing a Cu plate material on the base material body and holding the base material body and the Cu plate material together in a vacuum furnace at 1150° C. for 2 hours. In this way, there was obtained the electrode material according to Example 6. The tensile strength of the electrode material according to Example 6 was measured and continued to be equivalent in value to that of a conventional electrode material. Further, the electrical conductivity of the electrode material according to Example 6 was measured and confirmed to be equivalent in value to that of the electrode material according to Example 1.

As mentioned above, the electrode material with superior interruption and withstand voltage capabilities was obtained even when the molded body and the integrally molded body were each subjected to sintering.

Example 7

An electrode material according to Example 7 was an electrode material produced by sintering the integrally molded body, without sintering the molded body, and infiltrating the resulting base material body with Cu. Herein, the electrode material according to Example 7 was characterized in that the center part was formed with a large area.

A MoCr fine powder of 5.7 μm median diameter (MoCr weight ratio: Mo:Cr=9:1) was molded with a press pressure of 3 t/cm$^2$, thereby forming a molded body with a diameter ϕ of 63 mm and a length L of 24 mm. A Cr powder (median diameter: 64 μm) was filled on an outer circumference of the molded body and molded with a press pressure of 3 t/cm$^2$, thereby forming an integrally molded body with a diameter ϕ of 80 mm and a length L of 24 mm. The integrally molded body was sintered at 1150° C. for 1.5 hours under a vacuum atmosphere and thereby processed into a base material body (porous composite sintered body). The thus-formed base material body was infiltrated with Cu by placing a Cu plate material on the base material body and holding the base material body and the Cu plate material together in a vacuum furnace at 1150° C. for 2 hours. In this way, there was obtained the electrode material according to Example 7. The tensile strength and electrical conductivity of the electrode material according to Example 7 were measured and confirmed to be equivalent in value to those of the electrode material according to Example 1.

As mentioned above, the electrode material with superior interruption and withstand voltage capabilities was obtained without any problem even when the center part of the integrally molded body were made larger in diameter.

Example 8

An electrode material according to Example 8 was an electrode material produced by sintering the integrally molded body, without sintering the molded body, and infiltrating the resulting base material body with Cu. In this Example, the Mo:Cr weight ratio and median diameter of the MoCr powder used as the raw material was different from those in the other Examples. For production of the electrode material according to Example 8 (and for production of the after-mentioned electrode material according to the Example 9), a MoCr fine powder was prepared using a Cr powder of 18 μm median diameter. Even under the same firing conditions of the MoCr solid solution powder, the particle diameters of the MoCr solid solution powder becomes large due to the formation of residual Cr particles and secondary particles (as aggregates), which causes an impairment of the fine dispersibility of the solid solution particles in the electrode material, as the content rate of Cr in the MoCr solid solution powder increases. In other words, it becomes difficult to pulverize the MoCr solid solution powder so that the median diameter of the MoCr solid solution powder tends to become large as the content rate of Cr in the MoCr solid solution powder increases. For this reason, a Cr powder of relatively small particle diameter is used for preparation of a MoCr solid solution powder of relatively high Cr content rate e.g. in the range of Mo:Cr=1:3 to 3:1 so as to allow fine dispersion of CuCrMo structures.

Prepared was the MoCr fine powder of 7.1 μm median diameter (MoCr weight ratio: Mo:Cr=3:1). The MoCr fine powder was molded with a press pressure of 3 t/cm$^2$, thereby forming a molded body with a diameter ϕ of 40 mm and a length L of 24 mm. A Cr powder (median diameter: 64 μm) was filled on an outer circumference of the molded body and molded with a press pressure of 3 t/cm$^2$, thereby forming an integrally molded body with a diameter ϕ of 80 mm and a length L of 24 mm. The integrally molded body was sintered at 1150° C. for 1.5 hours under a vacuum atmosphere and thereby processed into a base material body (porous composite sintered body). The thus-formed base material body was infiltrated with Cu by placing a Cu plate material on the base material body and holding the base material body and the Cu plate material together in a vacuum furnace at 1150° C. for 2 hours. In this way, there was obtained the electrode material according to Example 8. The electrical conductivity of the electrode material according to Example 8 was measured at both sides. It was confirmed that: the electrical conductivity of the center part (CuCrMo region) of the electrode material was 30% IACS; and the electrical conductivity of the outer circumferential part (CuCr region) of the electrode material was 21% IACS.

As mentioned above, the electrode material with superior interruption and withstand voltage capabilities was obtained even when the mixing ratio was changed to Mo:Cr=3:1.

Example 9

An electrode material according to Example 9 was an electrode material produced by sintering the integrally molded body, without sintering the molded body, and infiltrating the resulting base material body with Cr. In this Example, the Mo:Cr weight ratio and median diameter of the MoCr powder used as the raw material was different from those in the other Examples.

A MoCr fine powder of 23.7 μm median diameter (MoCr weight ratio: Mo:Cr=1:1) was prepared and molded with a press pressure of 3 t/cm$^2$, thereby forming a molded body with a diameter ϕ of 40 mm and a length L of 24 mm. A Cr powder (median diameter: 64 μm) was filled on an outer circumference of the molded body and molded with a press pressure of 3 t/cm$^2$, thereby forming an integrally molded body with a diameter ϕ of 80 mm and a length L of 24 mm. The integrally molded body was sintered at 1150° C. for 1.5 hours under a vacuum atmosphere and thereby processed into a base material body (porous composite sintered body). The thus-formed base material body was infiltrated with Cu by placing a Cu plate material on the base material body and holding the base material body and the Cu plate material together in a vacuum furnace at 1150° C. for 2 hours. In this way, there was obtained the electrode material according to Example 9. The electrical conductivity of the electrode material according to Example 9 was measured at both sides. It was confirmed that: the electrical conductivity of the center part (CuCrMo region) of the electrode material was 29% IACS; and the electrical conductivity of the outer circumferential part (CuCr region) of the electrode material was 22% IACS.

As mentioned above, the electrode material with superior interruption and withstand voltage capabilities was obtained even when the mixing ratio was changed to Mo:Cr=1:1.

Reference Example 1

An electrode material according to Reference Example 1 was an electrode material with no outer circumferential part (CuCr region). For production of the electrode material according to Reference Example 1, used was a Mo powder of 2.8 to 3.7 μm particle size. When the particle size distribution of the Mo powder was measured by a laser diffraction particle size analyzer, the median diameter d50 of the Mo powder was determined to be 5.1 μm (d10=3.1 μm, d90=8.8 μm). Also used was a Cr powder of −325 mesh (sieve opening size: 45 μm).

The Mo powder and the Cr powder were first mixed at a weight ratio of 9:1. The mixed powder was subjected to firing and pulverization, thereby forming a MoCr powder. The median diameter of the MoCr fired powder was 5.7 μm (as measured by a laser diffraction particle size analyzer). The MoCr powder was molded. The resulting molded body was sintered. The sintered body was subjected to HIP treatment and then infiltrated with Cu. In this way, there was obtained the electrode material according to Reference Example 1. The electrode material according to Reference Example 1 had a composition of Cu:Cr:Mo=25:7.5:67.5 (weight ratio).

Reference Example 2

An electrode material according to Reference Example 2 was an electrode material with no outer circumferential part (CuCr region). For production of the electrode material according to Reference Example 2, raw materials used were a Mo powder of 2.8 to 3.7 μm particle size and a Cr powder of 20 μm median diameter (each as measured by a laser diffraction particle size analyzer).

The Mo powder and the Cr powder were mixed at a weight ratio of 3:1. The mixed powder was subjected to firing and pulverization, thereby forming a MoCr powder. The MoCr powder was molded (press pressure 3.6 t/cm$^2$). The resulting molded body was sintered. The sintered body was infiltrated with Cu. In this way, there was obtained the electrode material according to Reference Example 2. The electrode material according to Reference Example 2 had a composition of Cu:Cr:Mo=50:12.5:37.5.

Comparative Example 1

An electrode material according to Comparative Example 1 was a conventional CuCr electrode material containing 50 wt % of Cu and 50 wt % of Cr.

The electrode material according to Comparative Example 1 was produced by molding a Cr powder, sintering the molded body and infiltrating the resulting base material body with Cu.

The electrode materials according to Reference Examples 1 and 2 and the electrode material according to Example 1 were formed into the same diameter, respectively mounted on vacuum interrupters and subjected to current forming. The number of current forming treatments performed on the vacuum interrupter with the electrode material according to Reference Example 1 to reach a set achievement voltage was 1.5 times or more that for the vacuum interrupter with the electrode material according to Reference Example 2. The current value required for the current forming of the vacuum interrupter with the electrode material according to Reference Example 1 was 1.2 times or more as large as the current value required for the current forming of the vacuum interrupter with the electrode material according to Reference Example 2. Further, the vacuum interrupter with the electrode material according to Reference Example 2 was unstable in withstand voltage due to the occurrence of fouling in the vacuum interrupter during the current forming.

The vacuum interrupter with the electrode material according to Example 1 was subjected to the same number of current forming treatments as that of the vacuum interrupter with the electrode material according to Reference Example 2. Before and after the current forming, the contact resistance of the electrode material was decreased by 10%. As is apparent from this result, the contact resistance of the surface of the electrode material according to Example 1 was decreased by the interruption of large current so that the electrode material had good resistance to welding caused due to the contact resistance.

Furthermore, electrode contacts were formed of the electrode materials according to Comparative Example 1 and Example 1 and mounted to vacuum interrupters, respectively. TABLES 1 and 2 show the results of surface roughness measurements of the electrode contacts in the vacuum interrupters after a plurality of interruption operations. The measurement results of Comparative Example 1 are shown in TABLE 1; and the measurement results of Example 1 are shown in TABLE 2.

TABLE 1

| | Measured part | | | |
|---|---|---|---|---|
| | Center part | | Outer circumferential part | |
| Roughness | Ra | Rz | Ra | Rz |
| Measured value | 1.12 | 4.75 | 0.45 | 1.98 |
| | 1.13 | 4.63 | 0.51 | 2.32 |
| | 0.95 | 4.1 | 0.54 | 2.37 |
| | 1.07 | 4.43 | 0.46 | 2.11 |
| | 1.05 | 4.14 | 0.48 | 2.17 |
| Average | 1.06 | 4.41 | 0.49 | 2.19 |

TABLE 2

| | Measured part | | | |
|---|---|---|---|---|
| | Center part | | Outer circumferential part | |
| Roughness | Ra | Rz | Ra | Rz |
| Measured value | 0.7 | 2.67 | 0.54 | 2.29 |
| | 0.75 | 2.85 | 0.54 | 2.34 |
| | 0.76 | 2.84 | 0.62 | 2.56 |
| | 0.72 | 2.69 | 0.57 | 2.4 |
| | 0.76 | 2.9 | 0.56 | 2.5 |
| Average | 0.74 | 2.79 | 0.57 | 2.42 |

As is apparent from comparison of TABLES 1 and 2, the surface roughness of the electrode material according to Example 1, particularly the surface roughness of the center part of the electrode material, was smaller than that of the electrode material according to Comparative Example 1. It is thus assumed that the factor of increase of contact resistance was reduced to a lower degree in the electrode material according to Example 1 than in the electrode material according to Comparative Example 1.

The vacuum interrupters with the electrode contacts formed of the electrode materials according to Reference Example 2 and Example 1 were also tested by capacitor switching test (72 kV, 20 MVA, TRV 72.5 kV/$\sqrt{3}\times1.4\times2\sqrt{2}$, interrupting current 160 A) and by interruption test (interrupting current 25 kArms, interrupting current phase angle 40 to 250 degrees, TRV 132 kVpeak (0.75 kV/μs)).

As shown in FIG. 7, each of the vacuum interrupter with the electrode material according to Reference Example 2 and the vacuum interrupter with the electrode material according to Example 1 showed a good interruption test result (that is, showed an interruption range as specified by standards). The vacuum interrupter with the electrode material according to Example 1 showed a reignition probability of 0% in the capacitor switching test and had superior capacitor switching capability to that of the vacuum interrupter with the electrode material according to Reference Example 2.

As described above, the electrode material is obtained with superior interruption and withstand voltage capabilities by the electrode material manufacturing method according to the embodiment of the present invention. The electrode material can be obtained with superior capacitor switching capability. The electrode material can also be obtained with superior energization capability. The number and energy cost of surface forming treatments required for the electrode material is reduced by forming the high-withstand-voltage CuCr region around the outer circumference of the center part in which not only MoCr particles but also Cu structures are finely dispersed. As a consequence, the electrode material can prevent the inside of the vacuum interrupter from being fouled by the surface forming treatment of the interrupter contact and thus attains superior interruption and capacitor switching capabilities.

Since the integrally molded body in which the Cr powder is filled and molded around the center part of MoCr powder is infiltrated with Cu, the joint of the center part and the outer circumferential part is strengthened with the aid of the phenomenon of dissolution and diffusion of Cr into MoCr due to the Cu infiltration. In other words, the joint strength of the center part and the outer circumferential part is improved as Cr of the outer circumferential part is slightly dissolved in Cu and diffused from Cu into the MoCr particles of the center part.

Moreover, the shrinkage rate of the center part (molded body) during the sintering (or Cu infiltration) is made lower by forming the center part (molded body) from the MoCr solid solution powder. On the other hand, the molded body of the Cr powder is shrunk during the sintering (or Cu infiltration). Consequently, the mutual diffusion of elements at the boundary between the center part and the outer circumferential part is promoted by shrinkage of the outer circumferential part during the sintering (or Cu infiltration) of the integrally molded body whereby the joint of the center part and the outer circumferential part can be more strengthened.

The present inventors have previously developed an electrode material with superior interruption and withstand voltage capabilities as disclosed in Patent Documents 3 to 5. This electrode material has a configuration in which Cu structures are finely dispersed so that it is difficult to melt a surface of the electrode material by surface forming. By contrast, the electrode material according to the embodiment of the present invention has a configuration in which the high-withstand-voltage CuCr region is formed as the outer circumferential part. Hence, the number of current forming treatments required for the electrode material according to the embodiment of the present invention is significantly reduced so as to not only reduce the energy cost of current forming but also prevent the inside of the vacuum interrupter from being fouled by current forming.

Figure 8:
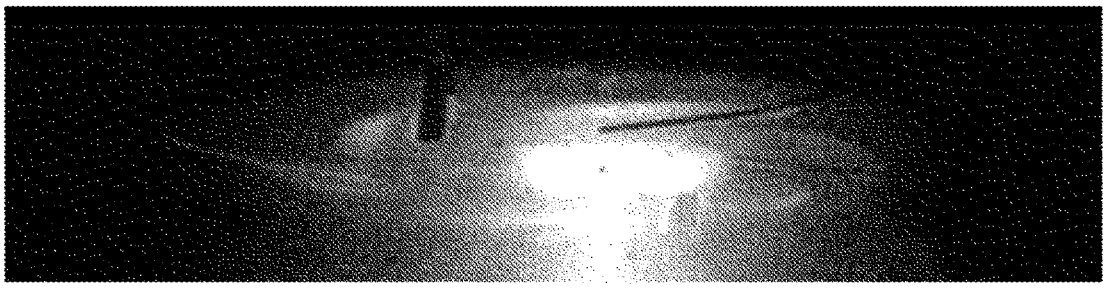
FIG. 8 is a pictorial view of a conventional electrode material (CuCr electrode) during 33-kA interruption.

A conventional electrode material (CuCr electrode material) causes, during forming treatment, interruption of current as arc generated over the entire electrode material converges to the center part of the electrode material as shown in FIG. 8. This results in a problem that contaminant elements (such as Cu, Cr etc.) are released to the inside of the vacuum interrupter from the surface of the electrode material by local heating of the center part of the electrode material.

During such current forming treatment, a CuCr surface phase in which fine Cr particles are dispersed is formed on a surface of the CuCr electrode material. As the CuCr surface phase is higher in withstand voltage than a CuCr bulk electrode material, the electrode material is improved in withstand voltage capability by the current forming treatment. Herein, the CuCr surface phase is formed originating from the center part of the electrode material such that the surface of the electrode material is covered with the CuCr surface phase after the forming treatment.

On the other hand, a CuCrMo electrode material has a configuration in which high-melting MoCr particles and Cu structures are finely dispersed so that it is difficult to melt a surface of the electrode material and difficult to form a finely dispersed surface phase on the surface of the electrode material. A large number of current forming treatments are hence required until reaching a set achievement voltage. This results in a large amount of energy required for the current forming treatments. In addition, there arises a possibility that the withstand voltage performance of the vacuum interrupter may become unstable by release of contaminant elements (such as Cu, Cr etc.) to the vacuum interrupter from the surface of the electrode material when a large number of current forming treatments are performed.

In the electrode material according to the embodiment of the present invention, the outer circumferential part is lower in melting point than the center part so that it is easy to form the finely dispersed CuCr surface phase (containing Mo derived from the center part). The electrode material can be thus provided with a set achievement voltage and reduced contact resistance by performing the same or similar number of current forming treatments as that for the conventional CuCr electrode material. During the current forming, a surface phase of high withstand voltage is formed on a surface of the electrode material. This surface phase is formed originating from the center part of the electrode material and is spread along a radial direction of the electrode material such that the surface of the electrode material is covered with the surface phase. In the center part, the surface phase is predominantly composed of MoCr or fine CuCrMo structures on the bulk CuCrMo material. In the outer circumferential part, the surface phase is predominantly composed of MoCr, Cr or CuCrMo structures on the bulk CuCr material. It is assumed that the withstand voltage capability of the entire electrode material can be improved by the current forming because either of the above surface phases is higher in hardness and withstand voltage than a bulk electrode material. The electrode material according to the embodiment of the present invention has a high hardness and high withstand voltage and attains a good capacitor switching capability. As not only the center electrode but also the surface phase formed by current forming (in particular, the surface phase formed on the surface of the outer circumferential part) are high in hardness, the surface of the electrode material can be prevented from being roughened by inrush current. The electrode material according to the embodiment of the present invention is hence suitable for use in a capacitor circuit in which a voltage twice or three times as high as the usual is applied between electrodes at the time of low current interruption and in which roughening of electrode surface can be caused by inrush current.

The electrode material according to the embodiment of the present invention as a whole maintains its energization capability as both of the center part and the outer circumferential part contain the same high conductivity element (e.g. Cu) as a main arc component. The enormous time required for stabilization of withstand voltage capability can be shortened by decreasing the area of the center part (e.g. MoCr body) in the surface of the electrode material. The center part of the electrode material is high in heat resistance and difficult to melt and thus shows improved resistance to local heating caused by convergence of arc at current interruption operation.

Conventionally, an electrode for a capacitor circuit is constructed by providing a large-diameter electrode portion of SUS to ensure a withstand voltage, and then, arranging a small-diameter electrode contact of CuCrMo material on the electrode portion. When the electrode contact is formed in this manner, there arises a problem that the interrupting current becomes very low with decrease in the area of the contact. Some contrivances have been adopted to increase the area of the contact for improvement of interruption capability. However, the increase of the area of the contact can cause an impairment of capacitor switching capability For improvement of capacitor switching capability and large-current interruption capability, modifications have been demanded to ensure energization capability. As a modification of the vacuum interrupter electrode configuration, there is previously known a composite contact material whose composition varies in a radial direction (see, for example, Patent Documents 8 to 10). The composite contact material however faces the problem of increase in contact resistance with the generation of disparity in main arc component by a plurality of large-current switching operations. Further, the composite contact material is not suitable for mass-production as vacuum application products due to complication of electrode configuration and production method.

The electrode material according to the embodiment of the present invention has a good capacitor switching capability, which eliminates the need for a SUS electrode portion to ensure the withstand voltage. Even when the electrode material is made larger in diameter for a larger contact area, the amount of energy required for stabilization treatment of the electrode material is suppressed. The electrode material according to the embodiment of the present invention thus attains a good capacitor switching capability. Accordingly, the vacuum interrupter with the electrode material according to the embodiment of the present invention is substantially decreased in electrode diameter and overwhelmingly reduced in cost as compared to a conventional vacuum interrupter (e.g. with a contact of 20 to 30 mm diameter and a SUS electrode portion of 100 mm diameter).

The optimal area ratio of the center part and the circumferential part in the surface of the electrode material is varied depending on the electrode configuration, coil shape, arc diffusion state and the like. Hence, the optimal area ratio of the center part and the circumferential part is set arbitrarily in accordance with the electrode configuration, arc diffusion state and the like. Since the easy-to-melt region (i.e. the region in which the energy of collision of ions is large) is determined from the magnetic flux density between the electrodes, the optimal area ratio of the center part and the outer circumferential part is set according to the distribution of the magnetic flux density.

Although the electrode material and the electrode material manufacturing method according to the embodiments of the present invention have been described above with reference to the specific examples, it should be understood that: the present invention is not limited to the above specific embodiments; various changes and modifications of the embodiments are possible within the range does not impair the features of the present invention; and those changes and modifications are fairly included in the scope of the present invention.

For example, the center part can be made of the electrode material disclosed in Patent Documents 3 to 5 so as to allow fine and uniform dispersion of Cr-containing particles as well as fine and uniform dispersion of highly conductive Cr structures. In this case, the center part can be formed with superior withstand voltage and current interruption capabilities by increasing the content of the heat resistant element in the center part.

The average particle diameter of the fine particles (i.e. the solid solution particles of the heat resistant element and Cr) in the center part is preferably controlled to 20 μm or smaller, more preferably 15 μm or smaller, as determined according to the Fullman's equation. The center part can be formed with superior withstand voltage and current interruption capabilities by controlling the volume-based relative particle amount of particles of 30 μm or smaller diameter in the MoCr powder to be 50% or more. Further, the center part can be formed with superior current interruption and withstand voltage capabilities by controlling the dispersion state index CV of the fine particles of the center part in which the heat resistant element and Cr are mutually dissolved and diffused into each other (i.e. the solid solution particles of the heat resistant element and Cr) to be 2.0 or lower, preferably 1.0 or lower, as determined based on the average value and standard deviation of the distances between the mass centers of the fine particles.

The center part may be formed by sintering a mixed powder of a heat resistant element powder (e.g. Mo powder) and a Cr powder and infiltrating the resulting sintered body with Cu. In this case, the capacitor switching capability of the electrode material is lowered so that that the electrode material may not applicable to capacitor switching uses in terms of performance. However, the electrode material is superior in interruption capability and withstand voltage capability to conventional CuCr electrode materials and thus is applicable to any uses other than the capacitor switching uses.

The center part can be formed with superior withstand voltage and current interruption capabilities by increasing the content of the heat resistant element in the center part as mentioned above. There is a tendency that the higher the content of the heat resistant element in the center part, the more improved the withstand voltage capability of the center part. However, it may become difficult to infiltrate the center part with Cu when the center part contains only the heat resistant element (that is, does not contain Cr). The weight ratio of the heat resistant element to Cr in the solid solution powder as the raw material of the center part is thus preferably controlled to be 1 or more of the heat resistant element to 1 of Cr, more preferably 3 or more of the heat resistant element to 1 of Cr, still more preferably 9 or more of the heat resistant element to 1 of Cr, in order for the electrode material to attain superior withstand voltage capability.

Since the electrode material (in particular, the center part) according to the embodiment of the present invention is manufactured by an infiltration process, the filling rate of the electrode material becomes 95% or higher so that there occurs less surface roughening of the contact by arc at current interruption or current switching operation. In other words, the electrode material attains superior withstand voltage capability, with no minute projections and depressions generated on the surface of the electrode material due to the presence of pores. By the infiltration of Cu into the pores of the porous base material body, the electrode material shows higher mechanical strength and higher hardness than those of an electrode material manufactured by a sintering method and thereby attains superior withstand voltage and capacitor switching capabilities.

The MoCr solid solution powder is not limited to those prepared by the method described in the above embodiments. There can be used a MoCr solid solution powder prepared by any known technique (such as jet mill process or atomization process).

Although each of the molded body and the integrally molded body is formed by means of a press machine in the above embodiments, the formation of the molded body and/or the integrally molded body is not limited to such a molding technique. The molded body and the integrally molded body can be formed by any known technique. By performing HIP treatment after the main sintering and before the Cu infiltration, the filling rate of the MoCr sintered body can be increased to improve the withstand voltage capability of the electrode material.

The press pressure for formation of the center part may be different from the press pressure for formation of the integrally molded body. For example, electrode materials were obtained with superior withstand voltage capability even by setting the press molding pressure for the center part to 3 t/cm$^2$ while changing the press molding pressure for the integrally formed body to 2.5 t/cm$^2$ or 2 t/cm$^2$ in Example 8. In this case, the electrical conductivity of the outer circumferential part was improved with decrease in the press pressure for the integrally molded body (more specifically, 22% IACS at 3 t/cm$^2$, 23% IACS at 2.5 t/cm$^2$ and 24% IACS at 2 t/cm$^2$).

The invention claimed is:

1. A method for manufacturing an electrode material, comprising:

forming a molded body by molding a powder of a solid solution of Cr and at least one kind of heat resistant element selected from Mo, W, Ta, Nb, V and Zr;

filling and molding a powder of Cr around an outer circumference of the molded body, thereby forming an integrally molded body; and infiltrating the integrally molded body with a conductive element selected from Cu, Ag and an alloy of Cu and Ag.

2. The method for manufacturing the electrode material according to claim 1, further comprising: sintering the integrally molded body, wherein, in the infiltrating, the sintered integrally molded body is infiltrated with the conductive element.

3. The method for manufacturing the electrode material according to claim 1, further comprising: sintering the molded body, wherein, in the filling and molding, the integrally molded body is obtained by filling and molding the powder of Cr around the sintered molded body.

4. The method for manufacturing the electrode material according to claim 1, wherein, in X-ray diffraction measurement of the powder of the solid solution, either a peak corresponding to Cr or a peak corresponding to the heat resistant element has disappeared.

5. An electrode material, comprising:

a center part having an current interruption capability; and an outer circumferential part disposed on an outer circumference of the center part, wherein the center part has a composite metal composition in which solid solution particles are uniformly dispersed in a Cu phase, the solid solution particles being formed of a solid solution of Cr and at least one kind of heat resistant element selected from Mo, W, Ta, Nb, V and Zr, wherein the composite metal composition comprises, in terms of a weight ratio with respect to the composite metal composition, 20 to 70% of Cu, 1.5 to 64% of Cr and 6 to 76% of the heat resistant element, with the balance being unavoidable impurities, wherein the solid solution particles in the composite metal composition have an average particle diameter of 20 μm or smaller and are uniformly dispersed in the Cu phase with a dispersion state index of 1.0 or lower as determined based on an average value and a standard deviation of distances between mass centers of the solid solution particles dispersed in the Cu phase, and wherein the outer circumferential part comprises 60 wt % or more of Cr based on a weight of the outer circumferential part, with the balance being Cu.

6. The electrode material according to claim 5, wherein the outer circumferential part comprises 75 wt % to 90 wt % of Cr based on the weight of the outer circumferential part.

* * * * *